US012656018B2

(12) United States Patent
Woods et al.

(10) Patent No.: US 12,656,018 B2
(45) Date of Patent: Jun. 16, 2026

(54) COVER FOR AN AIR CONDITIONER FOR SEALED ENCLOSURES

(71) Applicant: Hoffman Enclosures Inc., Anoka, MN (US)

(72) Inventors: Michael Woods, Elk River, MN (US); Michael Koehler, Ramsey, MN (US); Michael Rasmussen, Andover, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 766 days.

(21) Appl. No.: 17/944,955

(22) Filed: Sep. 14, 2022

(65) Prior Publication Data

US 2023/0081004 A1 Mar. 16, 2023

Related U.S. Application Data

(60) Provisional application No. 63/243,862, filed on Sep. 14, 2021.

(51) Int. Cl.
*F24F 13/20* (2006.01)
*F24F 1/0007* (2019.01)

(52) U.S. Cl.
CPC ..... *F24F 13/20* (2013.01); *F24F 1/0007* (2013.01)

(58) Field of Classification Search
CPC ..... F24F 13/20; F24F 1/58; F24F 1/56; F24F 1/0007; F24F 13/14; F24F 3/16
See application file for complete search history.

(56) References Cited

U.S. PATENT DOCUMENTS

| | | | |
|---|---|---|---|
| 3,328,929 | A | 7/1967 | Mullins |
| 3,357,763 | A | 12/1967 | Toper |
| 4,479,198 | A | 10/1984 | Romano et al. |
| 5,573,562 | A | 11/1996 | Schauwecker et al. |
| 5,935,282 | A | 8/1999 | Lin |
| 6,643,130 | B1 | 11/2003 | DeMarchis et al. |
| 8,827,778 | B2 | 9/2014 | Hartmann |
| 8,901,438 | B2 | 12/2014 | Lewis, II et al. |
| 9,115,904 | B2 | 8/2015 | Bringe et al. |
| 9,518,747 | B2 | 12/2016 | Lee et al. |
| 10,372,176 | B2 | 8/2019 | Chu et al. |
| 10,447,107 | B2 | 10/2019 | Miller et al. |
| 2009/0145153 | A1 | 6/2009 | Moynihan |

(Continued)

FOREIGN PATENT DOCUMENTS

| | | | |
|---|---|---|---|
| CN | 1880858 | A | 12/2006 |
| CN | 203163190 | U | 8/2013 |

(Continued)

*Primary Examiner* — Frantz F Jules
*Assistant Examiner* — Martha Tadesse
(74) *Attorney, Agent, or Firm* — Quarles & Brady LLP

(57) ABSTRACT

A cover is provided for an air conditioner of an enclosure. The cover can include a top wall and first and second side walls that at least partly define an interior compartment of the cover. The cover can further include a tab extending from the top wall into the interior compartment, a first side clip extending obliquely from the first side wall into the interior compartment, and a second side clip extending obliquely from the second side wall to the interior compartment. The tab and side clips can be configured to engage the air conditioner to retain the cover on the air conditioner.

19 Claims, 11 Drawing Sheets

(56) References Cited

U.S. PATENT DOCUMENTS

| | | | | |
|---|---|---|---|---|
| 2013/0040554 | A1* | 2/2013 | Hartmann | F24F 1/58 454/367 |
| 2014/0011440 | A1 | 1/2014 | Savchenko et al. | |
| 2016/0102885 | A1 | 4/2016 | Karkheck et al. | |
| 2020/0164297 | A1 | 5/2020 | Liao et al. | |

FOREIGN PATENT DOCUMENTS

| | | | | |
|---|---|---|---|---|
| CN | 110906457 | A | 3/2020 | |
| CN | 211261133 | U | 8/2020 | |
| CN | 111623507 | A * | 9/2020 | F24F 13/14 |
| CN | 211457596 | U | 9/2020 | |
| DE | 19641553 | C2 | 12/1999 | |
| DE | 102010003038 | B4 | 10/2017 | |
| DE | 102017105923 | B4 | 10/2018 | |
| DE | 202021100187 | U1 | 2/2021 | |
| EP | 2613054 | B1 | 3/2019 | |
| FR | 2987490 | B1 | 10/2014 | |
| JP | H09-243162 | A | 9/1997 | |
| JP | 2009-287854 | A | 12/2009 | |
| WO | 2020/000129 | A1 | 1/2020 | |

* cited by examiner

COVER FOR AN AIR CONDITIONER FOR SEALED ENCLOSURES

CROSS-REFERENCE TO RELATED APPLICATIONS

This application claims priority to U.S. provisional patent application No. 63/243,862, filed Sep. 14, 2021, the entirety of which is incorporated herein by reference.

BACKGROUND

Enclosures are often used in various industries to conceal, protect, and retain electrical components. In some cases, the electrical components within the enclosure must be maintained at a particular temperature and may require an air conditioner for the enclosure. Air conditioner covers can help to prevent ingress of water or other environmental material into an air conditioner or an associated enclosure.

SUMMARY

Some examples of the disclosed technology provide a cover for an air conditioner for an enclosure. The cover can include a first side wall, a second side wall, and a top wall that at least partly surround an interior compartment of the cover that is sized to receive an air conditioner, with the first side wall on an opposite side of the interior compartment from the second side wall. A tab can extend from the top wall of the cover into the interior compartment of the cover and arranged to engage the air conditioner to retain the cover on the air conditioner. A first side clip can extend obliquely from the first side wall of the cover into the interior compartment and arranged to engage the air conditioner to retain the cover on the air conditioner. A second side clip can extend obliquely from the second side wall of the cover into the interior compartment and arranged to engage the air conditioner to retain the cover on the air conditioner. An air intake opening can be configured for air flow into the interior compartment.

In some examples, the first side clip can be a first angled tab configured to seat on an edge of a support plate of the air conditioner adjacent to the first side wall within the interior compartment. The second side clip can be a second angled tab configured to seat on the edge of the support plate of the air conditioner adjacent to the second side wall within the interior compartment.

In some examples, the first and second side clips can angle obliquely away from the first and second side walls, respectively, toward an open bottom end of the cover. The first and second side clips can be configured to engage the air conditioner to secure the cover against lateral movement without use of separate fasteners. The tab can extend perpendicularly from the top wall and can be configured to be removably received in a bracket opening on a bracket of the air conditioner within the interior compartment to secure the cover against lateral and downward movement without use of fasteners, the bracket opening being arranged adjacent to the top wall.

In some examples, a front wall can define the air intake opening into the interior compartment. A shroud forward of the front wall can define an internal shroud area in communication with the air intake opening, and an air inlet opening of the shroud that opens into the internal shroud area. A support shelf can extend from the front wall into the internal shroud area adjacent a retention frame. The support shelf can be arranged to support filter media relative to gravity adjacent to the retention frame. The retention frame can be arranged to support filter media relative to air flow into the interior compartment from the internal shroud area. A filter guide can be disposed within the internal shroud area and above the support shelf, the filter guide being angled downwardly toward the air inlet opening to guide filter media toward the air intake opening defined by the front wall of the cover as the filter media can be received upwardly into the internal shroud area. The filter guide can be integrally formed with the front wall of the cover. The front wall can define an air filter recess adjacent to the air intake opening. The retention frame can extend across the air filter recess so that the retention frame can be spaced apart from the air intake opening by a flow gap.

Some examples of the disclosed technology can provide a covered air conditioner for an enclosure having an interior volume. A frame can be configured to attach to an enclosure to support air conditioning components adjacent to an air-exchange opening of the enclosure. One or more side support brackets can be arranged to extend from the frame away from the enclosure when the frame can be attached to the enclosure, the one or more side support brackets defining a first support side wall and a second support side wall opposite the first support side wall. A top support bracket can be arranged to extend away from the enclosure when the frame is attached to the enclosure. The top support bracket can have a top support wall that defines a top support bracket opening. A cover can be removably attachable to the frame to cover the air conditioning components. The cover can include: a cover top wall, a first cover side wall, and a second cover side wall (e.g., opposite the first cover side wall) that at least partly define an interior compartment configured to receive the air conditioning components. A tab can extend from the cover top wall and can be received in the top support bracket opening of the top support bracket to secure the cover against movement in a first direction relative to the frame.

A first side clip can extend from the first cover side wall and can be slidably seated on the first support side wall of the one or more side support brackets to secure the cover against movement in a second direction relative to the frame, the second direction being different than the first direction. A second side clip can extend from the second cover side wall and can be slidably seated on the second support wall of the one or more side support brackets to secure the cover against movement in the second direction.

In some examples, the top support wall of the top support bracket can be adjacent to and extends in parallel with a top frame wall of the frame.

In some examples, a fan can be supported by the top support bracket. The cover can include an air intake opening surrounded by an annular flange, the annular flange being aligned with an annular rim of the fan when the cover can be removably attached to the frame, to define an air intake passage of the air conditioner.

In some examples, one or more side support brackets can extend from a bottom portion of the frame and support a drainage grate.

In some examples, the cover can include a shroud arranged to extend away from the enclosure when the cover is removably attached to the frame. The shroud can define an air inlet opening of the cover that opens in a downward direction relative to the cover top wall. A first portion of a front wall of the cover below the air inlet opening can angle downwardly away from the interior compartment.

In some examples, a second portion of the front wall of the cover that is below the first portion of the front wall can include one or more fastener openings to secure the cover to the one or more side support brackets of the frame.

Some examples of the disclosed technology can include a method for attaching a cover to an air conditioner for an enclosure. A cover can be positioned to align an interior compartment of the cover with a frame of the air conditioner. The frame can be secured to the enclosure. The cover can include a first side wall, a second side wall opposite the first side wall, and a top wall that together at least partly define the interior compartment. The cover can define an air intake opening that permits air flow into the interior compartment. After aligning the interior compartment of the cover with the frame, the cover can be lowered onto the frame to one or more of: engage an opening defined on a top support wall of a first support bracket of the frame with a tab extending from the top wall of the cover into the interior compartment; engage a first support side wall of one or more side support brackets of the frame with a first side clip of the cover, the first side clip extending obliquely from the first side wall of the cover into the interior compartment; and engage a second support side wall of the one or more side support brackets that can be opposite the first support side wall with a second side clip of the cover, the second side clip extending obliquely from the second side wall of the cover into the interior compartment.

In some examples, the first side clip can engage a first top edge of the first support side wall and the second side clip engages a second top edge of the second support side wall.

In some examples, the tab of the cover can be received in the opening of the top support wall of the first support bracket. The first side clip can extend along an interior side of the first support side wall of the one or more side support brackets. The second side clip can extend along an interior side of the second support side wall of the one or more side support brackets.

In some examples, after lowering the cover onto the frame, the cover can be supported by the top support wall of the first support bracket relative to the frame. The first and second side clips can prevent movement of the cover downward or laterally relative to the frame. The tab can prevent movement of the cover toward or away from the enclosure.

In some examples, after lowering the cover onto the frame, a front wall of the cover can be secured to a front support wall of the one or more side support brackets with one or more fasteners.

BRIEF DESCRIPTION OF THE DRAWINGS

The accompanying drawings, which are incorporated in and form a part of this specification, illustrate examples of the disclosed technology and, together with the description, serve to explain the principles of examples of the disclosed technology.

DETAILED DESCRIPTION

Figure 1:
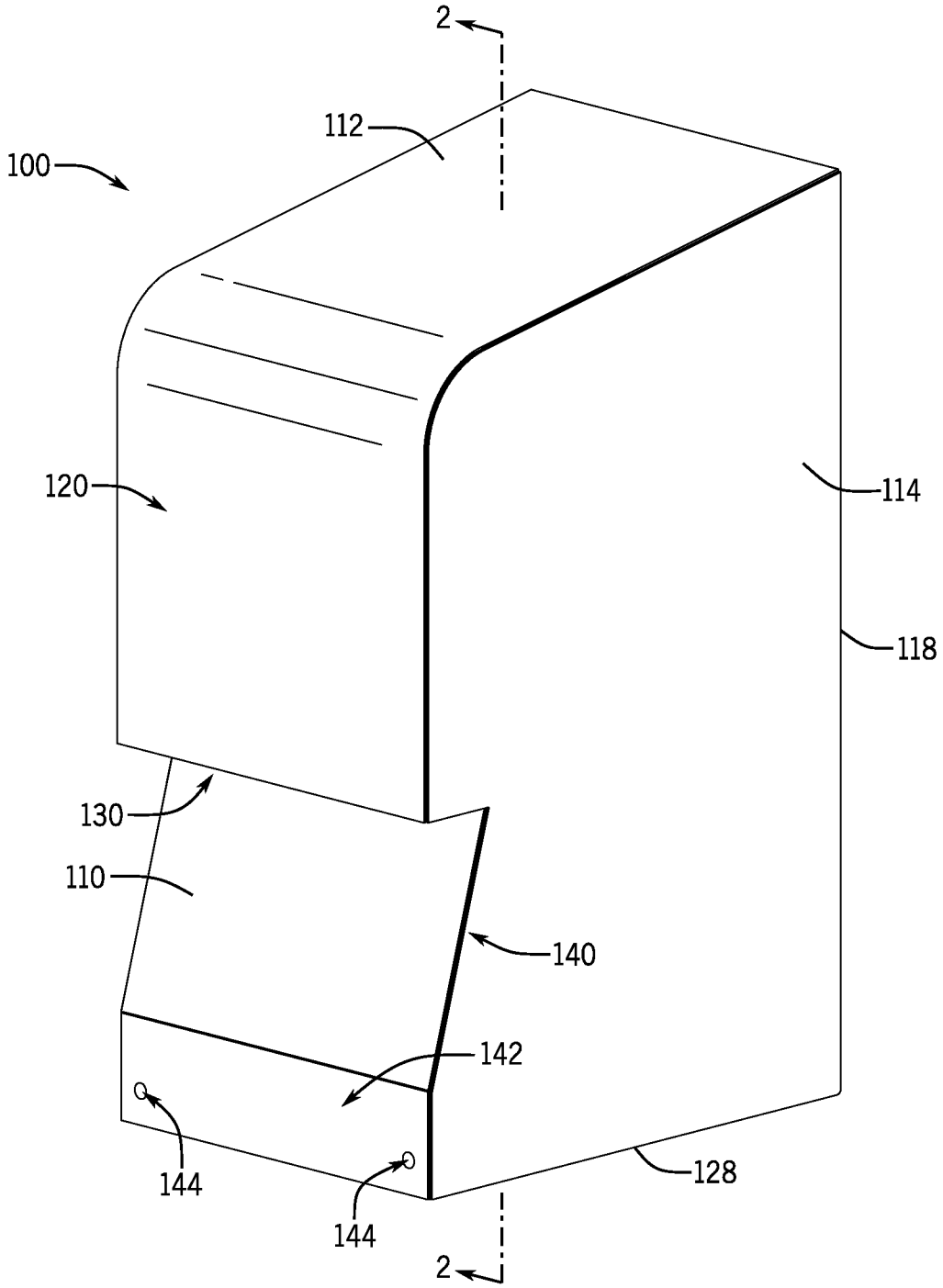
FIG. 1 is a front isometric view of a cover for an air conditioner according to an example of the disclosed technology.

Before any examples of the disclosed technology are explained in detail, it is to be understood that the disclosed technology is not limited in its application to the details of construction and the arrangement of components set forth in the following description or illustrated in the following drawings. The disclosed technology is capable of other examples and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise limited or defined, discussion of particular directions is provided by example only, with regard to particular examples or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or examples. Further, references to particular rotational or other movements (e.g., counterclockwise rotation) is generally intended as a description only of movement relative a reference frame of a particular example of illustration.

The following discussion is presented to enable a person skilled in the art to make and use examples of the disclosed technology. Various modifications to the illustrated examples will be readily apparent to those skilled in the art, and the generic principles herein can be applied to other examples and applications without departing from examples of the disclosed technology. Thus, examples of the disclosed technology are not intended to be limited to examples shown, but are to be accorded the widest scope consistent with the principles and features disclosed herein. The following detailed description is to be read with reference to the figures, in which like elements in different figures have like reference numerals. The figures, which are not necessarily to scale, depict selected examples and are not intended to limit the scope of examples of the disclosed technology. Skilled artisans will recognize the examples provided herein have many useful alternatives and fall within the scope of examples of the disclosed technology.

Some of the discussion below describes a cover for an air conditioner for an enclosure, in which the cover is configured to be removably attachable to a frame of the air conditioner. The context and particulars of this discussion are presented as examples only. For example, examples of the disclosed technology can be configured in various ways, including with other shapes and arrangements of elements. Similarly, examples of the disclosed technology can be used for other types of air conditioners or enclosures or for other types of removable cover applications other than for use with an air conditioner for an enclosure.

As described above, enclosures can retain electrical components, which can generate undesirable heat within the interior volume of the enclosure. This heat removal can generally be accomplished by configuring an air conditioner to cool the interior volume of the enclosure. Thus, for example, one or more air conditioners may be installed at one or more inlets of the enclosure. In some circumstances, the air conditioners are stacked in series or are installed in tight spaces in which access to certain sides of the air conditioner is limited. However, air conditioners require routine maintenance and service over the life cycle of the air conditioner which often requires removal of an outer cover of the air conditioner by a technician. Thus, a cover for an air conditioner that secures to the frame using no fasteners or with easily accessible fasteners would be beneficial.

Conventional arrangements for attaching a cover to an air conditioner for an enclosure utilize fasteners on the front and sides of the air conditioner frame and the cover. Thus, to remove the cover, a user must remove the fasteners from the sides of the cover. This task can be arduous and time consuming in some circumstances, as it can require removing fasteners on the sides of the air conditioner where there is little to no space to insert a tool to remove the fasteners. Further, fastener openings can create potential ingress points for water (e.g., during high-pressure cleaning) or other contaminants, and may thus require sealing or other appropriate treatment.

Examples of the disclosed technology can address these or other issues. For example, in some implementations a cover can be provided that can removably attach to a frame of the air conditioner without any fasteners to be installed. In other examples, a cover can be provided that can removably attach to a frame of the air conditioner and secured to the frame using a reduced number of fasteners as compared to conventional designs (e.g., with only fasteners located on the front of the cover, or without fasteners on one or both lateral sides of the cover). This general arrangement can be beneficial in many contexts. For example, such configurations may require a user to loosen only one or more fasteners that are easily accessible (e.g., may not require the removal of fasteners at the lateral sides or at the top of the air conditioner).

FIG. 1 illustrates an example cover 100 according to an example of the present disclosed technology, which collectively defines an interior compartment 102 sized to receive an air conditioner. The cover 100 includes a front wall 110, a top wall 112, a left (or first) side wall 114, and a right (or second) side wall 116 (see FIG. 2). The top wall 112 is angled downward toward the front wall 110, as may assist in shedding of water or other material. Further, a rear side 118 and a bottom side 128 of the cover 100 are open (see FIG. 3), including as may allow air flow into or out of an air-exchange opening of an enclosure (not shown) or drainage (e.g., of condensate) out of the cover 100.

Figure 2:
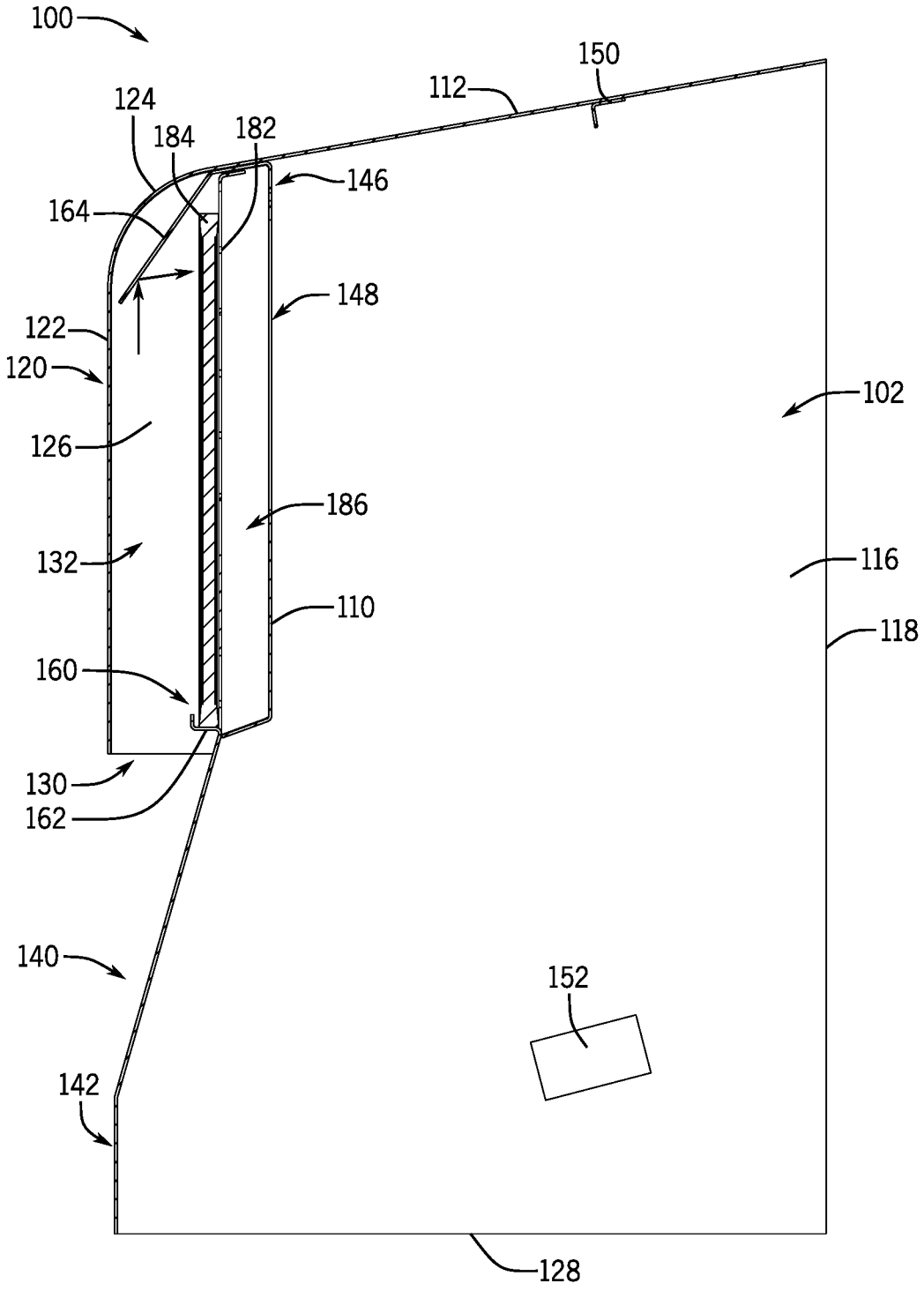
FIG. 2 is a cross-sectional view taken along line 2-2 of FIG. 1.
Figure 3:
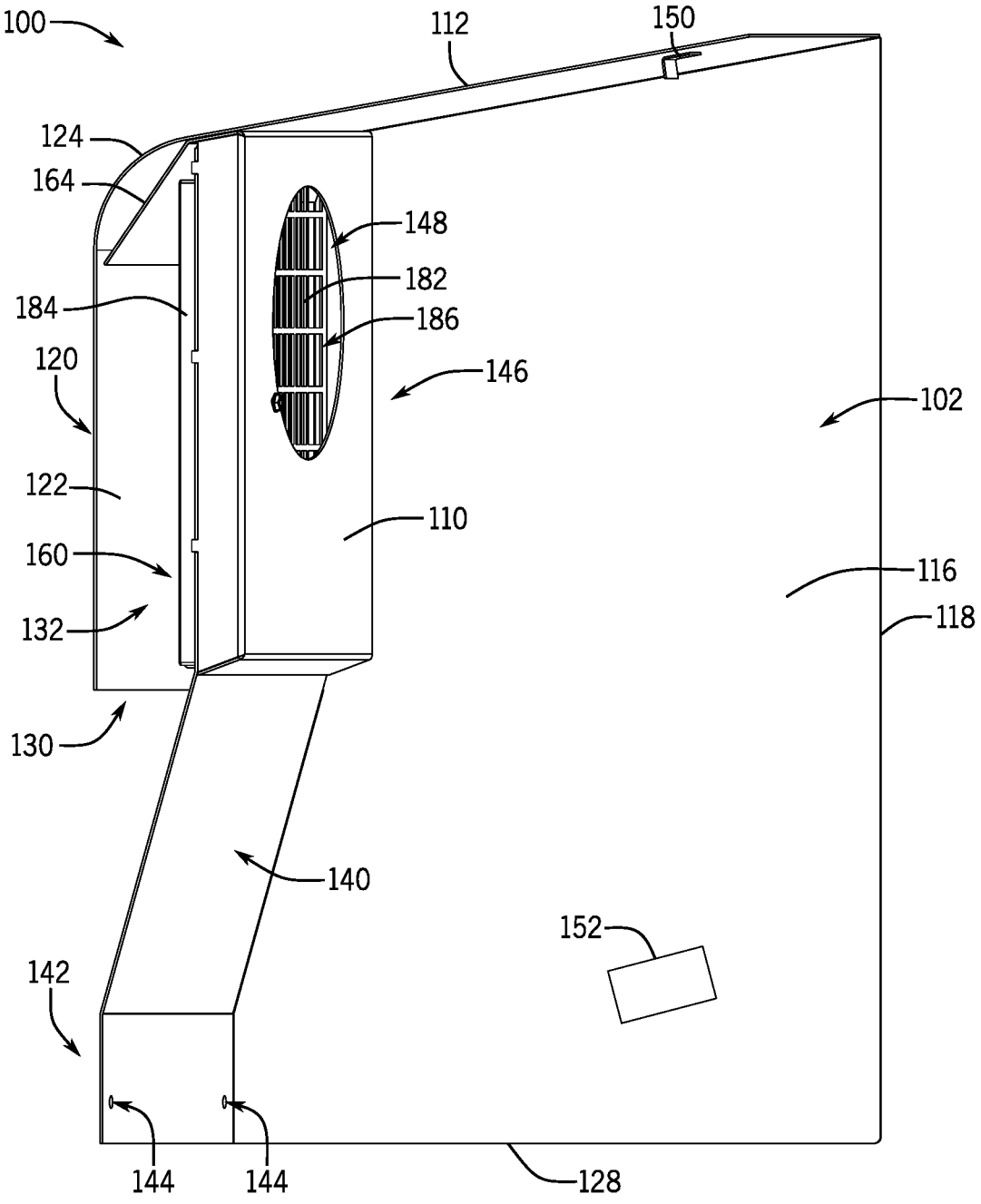
FIG. 3 is a sectional rear isometric view of the cover of FIG. 1.

FIG. 2 is a cross-sectional view taken along line 2-2 of FIG. 1, and FIG. 3 shows the example cover 100 of FIG. 1 in a sectional view so that the left side wall 114 is removed. A tab 150 is disposed on the top wall 112 of the cover 100 at a distance from the rear side 118 of the cover 100. In some cases, this distance may be greater than a corresponding depth of a frame of the air conditioner, as also further discussed below. Further, in the illustrated example, at least a portion of the tab 150 extends perpendicular to the angled top wall 112. A right (or second) side clip 152 is integrally formed or otherwise connected with the right side wall 116 of the cover 100, and a left (or first) side clip 154 is integrally formed or otherwise connected with the left side wall 114 (shown in FIG. 4) of the cover 100. An air intake opening 148 is disposed on an upper portion 146 of the front wall 110 of the cover 100.

In some examples, a shroud can be included on the front wall of, or otherwise extend from, the cover. For example, as illustrated, a shroud 120 is disposed on the front wall 110 of the cover 100 and defines an air inlet opening 130 of the cover 100. The shroud 120 includes a front wall 122, a top wall 124, a right (or second) side wall 126, and a left (or first) side wall (not shown) that together define an internal shroud area 132 that provides communication between the air inlet opening 130 and the air intake opening 148. In particular, the shroud 120 extends over the air intake opening 148 and the air inlet opening 130 of the shroud 120 is disposed at a distance below the air intake opening 148 disposed along the front wall 110.

In some examples, a portion of the front wall below the air inlet opening can be angled. For example, as illustrated, the front wall 110 includes a first bottom portion 140 and a second bottom portion 142 that is adjacent to the bottom side 128 of the cover 100. At least the first bottom portion 140 of the front wall 110 is angled downward from the air inlet opening 130. Further, one or more fastener holes 144 are disposed on the second bottom portion 142 of the front wall 110. In some cases, it may thus be useful for the second bottom portion 142 to extend at a different angle than the first bottom portion 140 (e.g., vertically).

In some examples, an air filter recess for filter media can be included in front of the air inlet opening and within the shroud. For example, as illustrated, a filter recess 160 is formed by the upper portion 146 of the front wall 110 to receive and provide flow through filter media (e.g., an air filter 184, as illustrated). A support shelf configured as a filter bracket 162 is included at a bottom of the filter recess 160 to support the filter media relative to gravity in front of the air intake opening 148. Two or more filter brackets 162 can be included to secure larger air filters within the filter recess 160. In the illustrated example, the filter brackets 162 are formed as elbow tabs, although other configurations are possible. As also shown in FIG. 2, a retention frame (e.g., a grating 182 as shown) can be arranged adjacent to the filter bracket 162 or another support shelf to support the filter media relative to air flow from the air inlet opening 130, through the internal area of the shroud 120, and then through the air intake opening 148 and into the interior compartment 102.

Generally, any variety of forms of a shelf can be similarly arranged to support filter media (e.g., discrete shelf sections like the brackets 162, a similarly contoured shelf that extends continuously over a larger width of the cover, an integrally bent lip of a larger front wall of a cover, etc.). Likewise, retention frames that are differently configured than the grating 182 (e.g., different gratings, screens, louvered structures, etc.) can be similarly located in other examples to similarly support filter media relative to air flow into the interior compartment of the relevant cover.

As also shown in FIG. 2, a filter guide 164 is disposed at an angle between the top wall 124 and the front wall 122 of the shroud 120. The filter guide 164 assists a user in installing the air filter 184 into the filter recess 160 and onto the filter bracket 162 within the shroud 120. For example, when a user inserts the air filter 184 into the shroud 120 via the air inlet opening 130, the angled inclination of the filter guide 164 can help to direct the top of the air filter 184 appropriately inward toward the air intake opening 148, as illustrated with arrows in FIG. 2. The air filter 184 can then be easily seated on the filter brackets 162 to be supported against gravity and the grating 182 (or otherwise secured) for support against intake air flow during operation. In some cases, a filter guide can also be integrally formed with a cover to provide improved manufacturing efficiency and other structural advantages. For example, as illustrated in FIG. 2, the filter guide 164 can extend integrally from a top end of the front wall 110 of the cover 100.

Recessed portions of a cover wall can also provide improved air flow into the interior compartment of the cover. For example, as also shown in FIG. 2, the recessed upper portion 146 of the front wall 110 can provide a flow gap 186 that separates the grating 182 from the air intake opening 148. For example, as measured between the grating 182 and the air intake opening 148, the flow gap 186 can be at least as wide as a distance between upstream and downstream faces of the air filter 184 as installed. As a result, more efficient air flow through the air filter 184 and into the interior compartment 102 can be achieved than may result from conventional designs.

Figure 4:
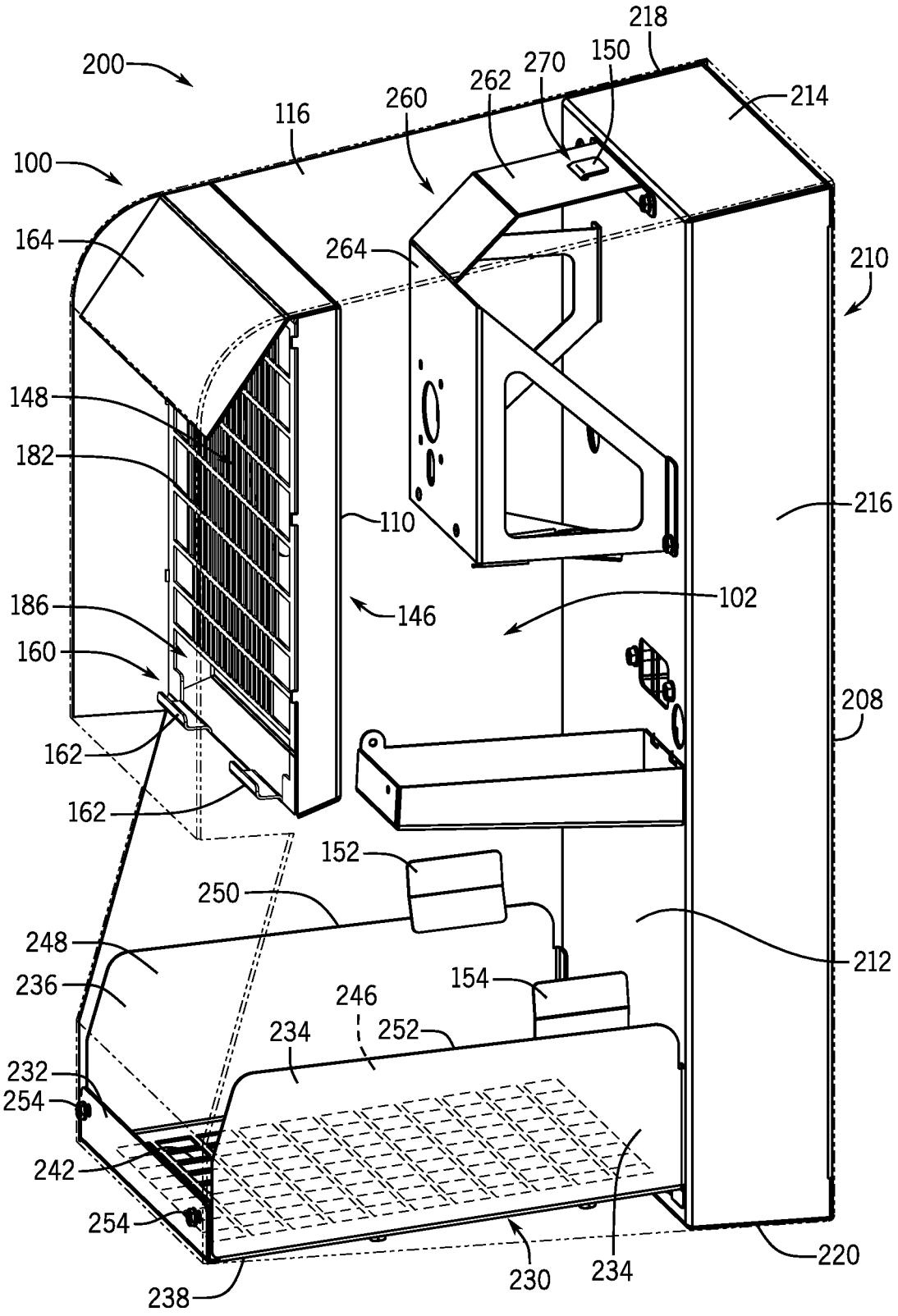
FIG. 4 front isometric view of an air conditioner for an enclosure according to an example of the disclosed technology, with a cover of the air conditioner rendered transparently to reveal internal components.
Figure 5:
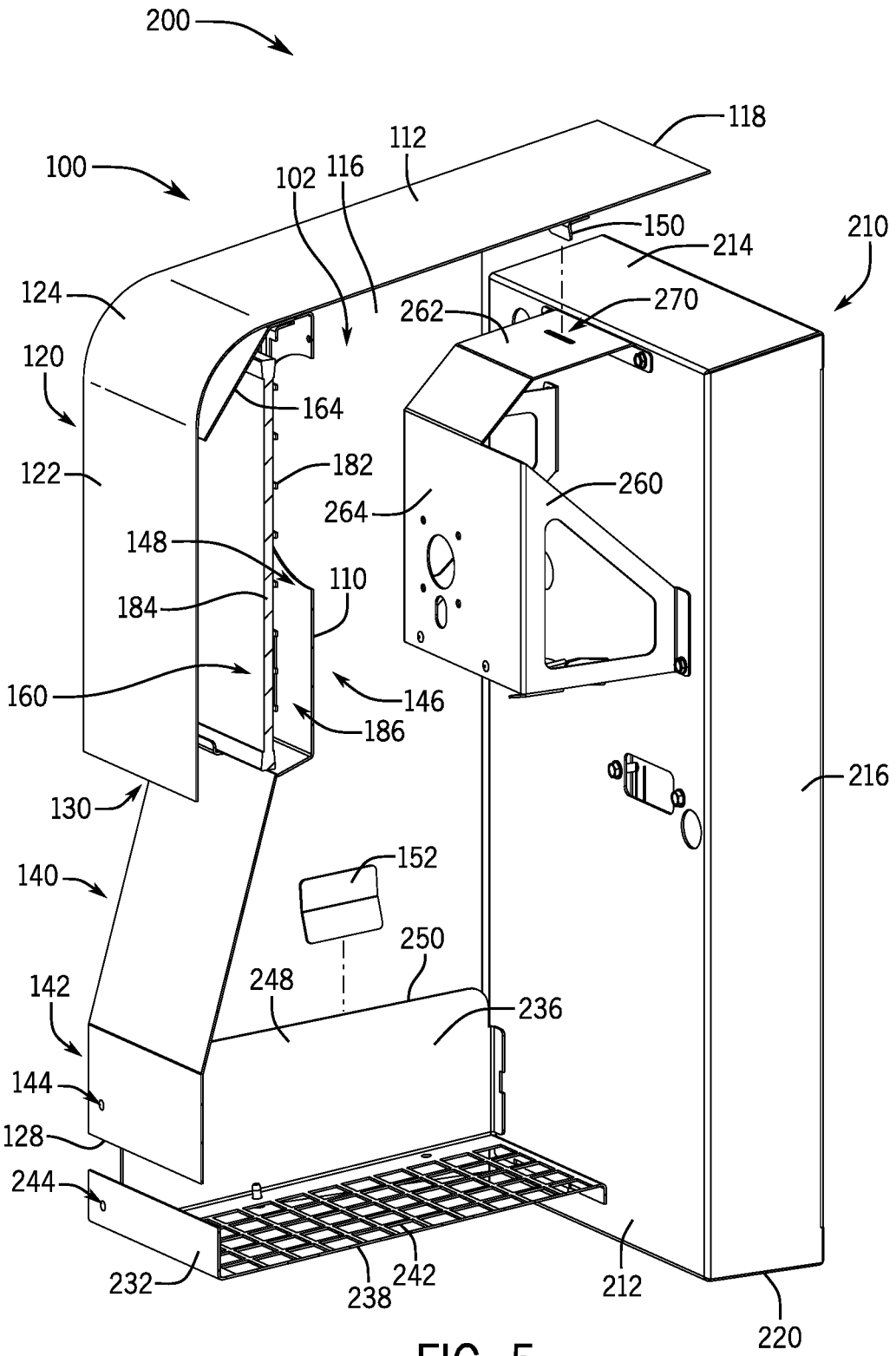
FIG. 5 partial exploded partial sectional isometric view of the air conditioner of FIG. 4.
Figure 6:
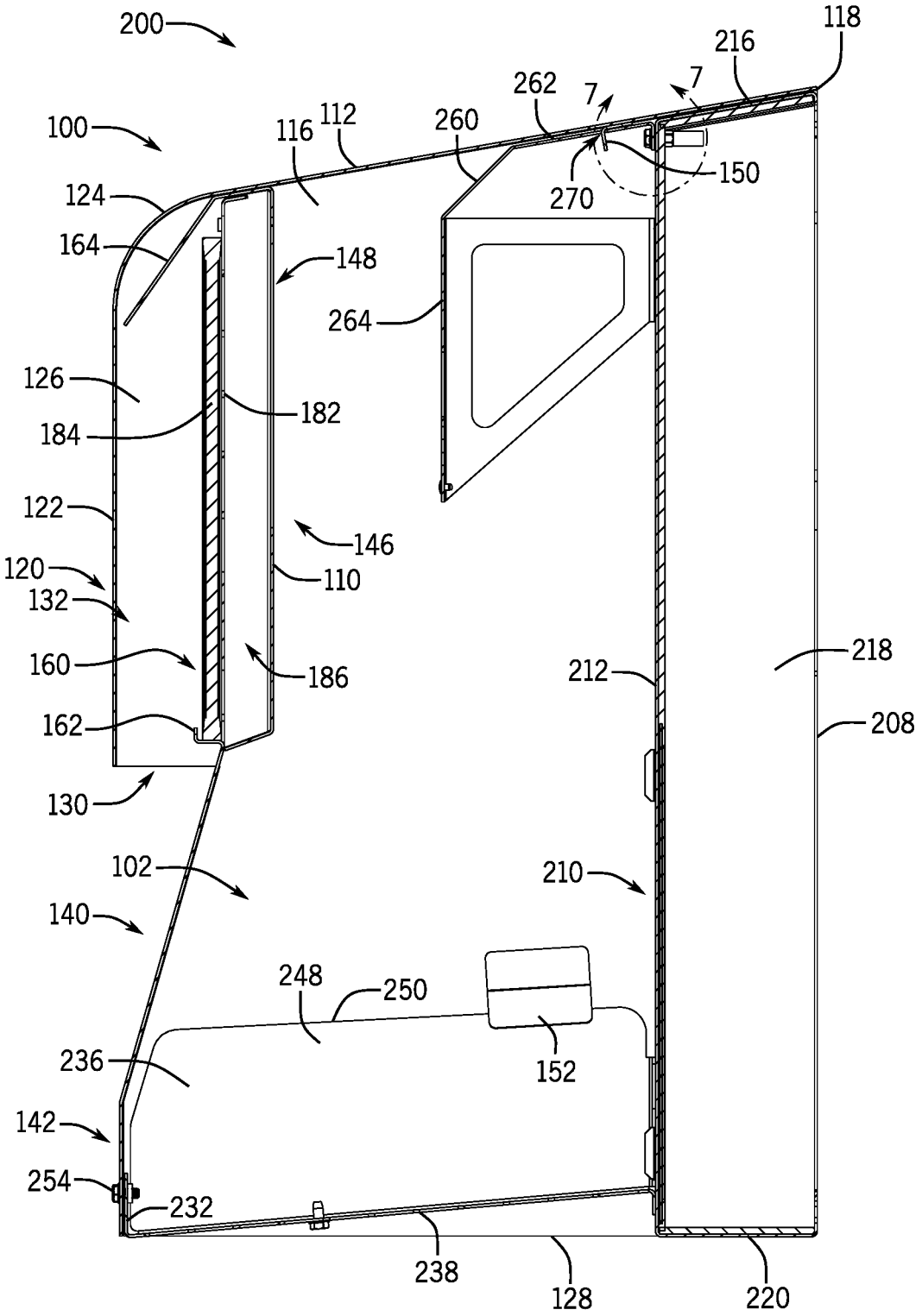
FIG. 6 is cross-sectional view of the air conditioner of FIG. 4.
Figure 8:
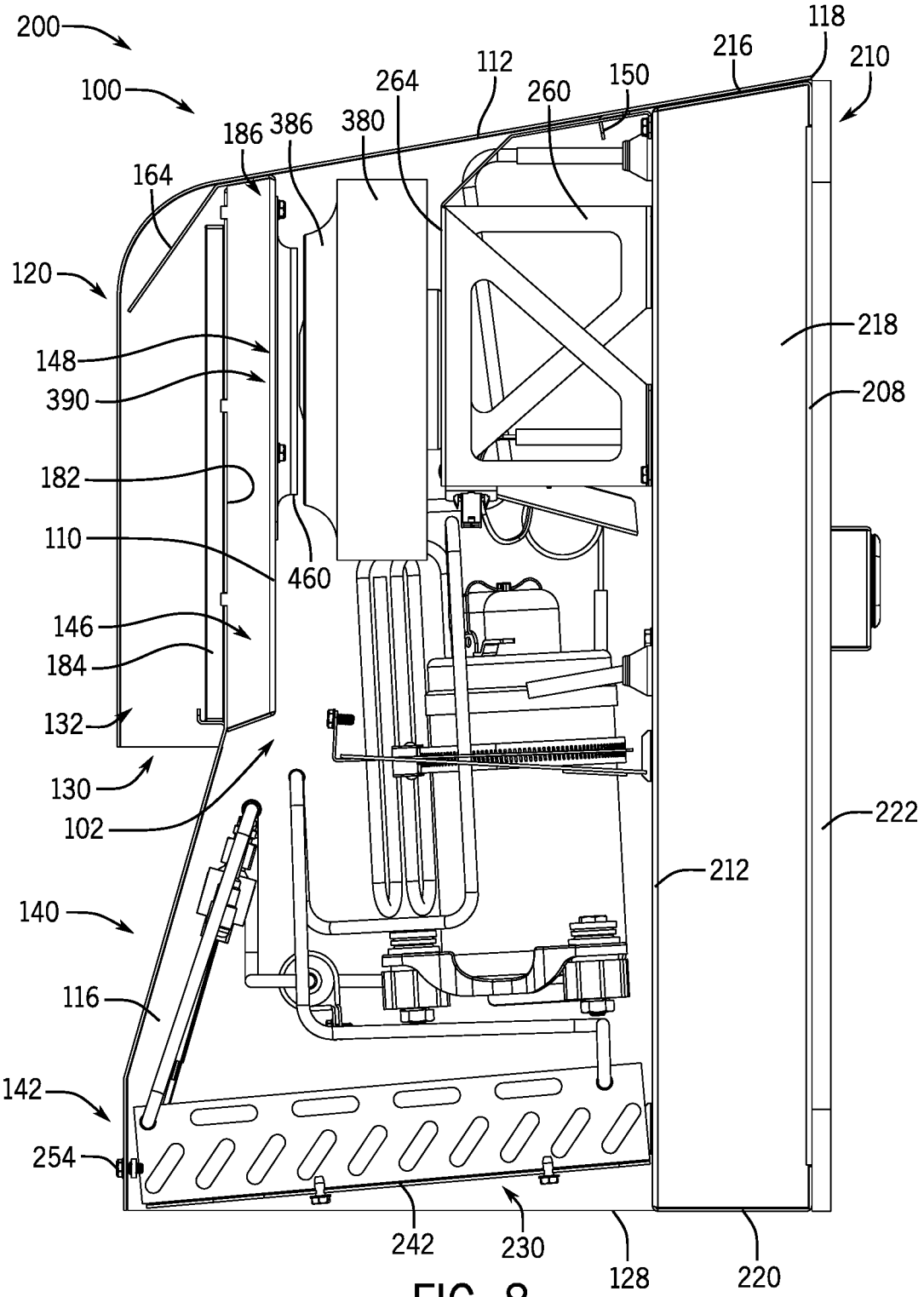
FIG. 8 is a partial side view of an air conditioner for an enclosure according to another example of the disclosed technology, with a cover of the air conditioner rendered transparently to reveal internal air conditioning components.

FIGS. 4-6 show an example air conditioner 200 for an enclosure (not shown) including the example cover 100 of FIGS. 1-3 removably attached to a frame 210. The frame 210 includes a front wall 212, a rear wall 208, a top wall 214, a left (or first) side wall 216, a right (second) side wall 218, and a bottom wall 220 (see FIG. 4). In some cases, the frame 210 can be configured to be attached to a side wall of an enclosure to surround and sealingly enclose air inlet or outlet openings for the enclosure, as well as certain equipment of the air conditioner 200 (e.g., an evaporator coil and associated fan as shown in FIG. 8). Accordingly, in some cases, a sealing gasket (e.g., gasket 222 of FIG. 8) can be arranged along the rear wall 208 of frame 210 to provide an external seal between the frame 210 and the enclosure.

Generally, one or more support brackets can be connected to a frame to removably support the cover 100 or other covers according to examples of the disclosed technology. In this regard, for example, a bracket 260 is attached to the front wall 212 of the frame 210, adjacent to the top wall 214 of the frame 210. The bracket 260 includes a bracket top wall 262 that is aligned with and parallel to the top wall 214 of the frame 210. An opening (e.g., elongate slot) 270 is disposed on the bracket top wall 262 and is configured to receive the tab 150 of the cover 100 to removably secure the cover 100 to the frame 210.

In other examples, an opening for a tab of a cover can be disposed on the top wall 214 of the frame 210. However, use of an opening on a separate bracket may be useful in some cases, including when a frame of an air conditioner is intended to seal certain components against leakage (e.g., as shown) so that inclusion of an opening might require careful sealing arrangements. In other examples, an air conditioner (e.g., a bracket on the frame 210) can include two or more openings and a cover can include two or more corresponding tabs. In other examples, the bracket 260 can be integrally formed with the front wall 212 of the frame 210.

Another support bracket, configured as a support tray 230 in the illustrated example, also extends from the front wall 212 and is disposed adjacent to the bottom wall 220 (see FIG. 4) of the frame 210. The support tray 230 is formed primarily from planar metal sheet segments, including a front wall 232, a left side wall 234, and a right side wall 236, and also includes a drainage grate 242 disposed on a bottom wall 238 of the support tray 230. In some examples, the support tray 230 is integrally formed with the frame 210. In some examples, other bracket arrangements are also possible, including with two separate side support brackets providing support structures similar to the side walls 234, 236 of the support tray 230.

The right side clip 152 of the cover 100 is configured to mechanically (e.g., slidably) engage (e.g., seat on) a right upper interior surface 248 of the right side wall 236 of the support tray 230, as formed by a right (or second) top edge 250 of the sheet metal plate that provides the right side wall 236 in the illustrated example. Similarly, the left side clip 154 (see FIG. 4) of the cover 100 is configured to mechanically (e.g., slidably) engage (e.g., seat on) a left upper surface 246 of the left side wall 234 of the support tray 230, as formed by a left (or first) top edge 252 of the sheet metal plate that provides the left side wall 234 in the illustrated example.

In some examples, side clips of a cover can extend obliquely relative to gravity or relative to a side wall of a cover. For example, as illustrated, the clips 152, 154 extend generally linearly along planes that are obliquely angled relative to gravity and the side walls 114, 116, although obliquely directed curved clips are also possible. Thus arranged, obliquely extending side clips can be easily and reliably engaged with supportive structures of a frame during installation, while providing substantial holding strength. In some cases, obliquely angled clips can assist in alignment and reliably securement of shrouds even though operators may not have visual confirmation of the precise location of the clips or related frame structures (e.g., due to the enclosed nature of the interior compartment 102). Thus, for example, during initial installation or subsequent adjustment, operators can easily seat and slide the obliquely angled clips 152, 154 along the frame 210 to help support the cover 100 as needed. Further, even if not seated on a frame so as to provide substantial vertical support for the cover 100, the oblique extension of the clips 152, 154 from the side walls 114, 116 can help to generally align the tab 150 in the lateral direction for installation into the opening 270.

In some examples, two or more left side clips 154 can engage the left side wall 234 of the support tray 230 and two or more right side clips 152 can engage the right side wall 236 of the support tray 230. In some cases, side clips of a cover may not necessarily engage a support tray or other lower support bracket when a cover is supported on an upper support bracket (e.g., the bracket 260), but may still generally extend to interior sides of side walls of the lower support bracket to prevent excessive lateral movement of the cover or to remedy (e.g., prevent or correct) excessive deformation of the relevant side walls of the cover. In other examples, the side walls 234, 236 of the support tray 230 can include one or more openings that can be configured to receive free ends of the side clips 152, 154 of the cover 100. In other examples, the left and right side walls 216, 218 of the frame 210 can include one or more openings can be configured to receive free ends of the side clips 152, 154 of the cover 100.

When the cover 100 is removably attached to the frame 210, the tab 150 of the cover 100 engages the opening 270 of the frame 210 (i.e., on the bracket 260) and the left and right side clips 154, 152 of the cover 100 are slidably moved to the interior sides of the left and right side walls 234, 236 of the support tray 230 along the left and right upper surfaces 246, 248, respectively. Moreover, the top wall 112 of the cover 100 contacts the top wall 214 of the frame 210, the left and right side walls 114, 116 of the cover 100 contact the left and right side walls 216, 218 of the frame 210, and the front wall 110 of the cover 100 contacts the front wall 232 of the support tray 230 of the frame 210. Thus, the cover 100 can be securely supported against gravity at least by the support bracket 260 and the frame 210, and the tab 150 and the side clips 154, 152 can help to prevent excessive movement of the cover 100 relative to the frame 210 (e.g., in forward and lateral directions) while still allowing the cover 100 to be removed from the air conditioner 200 by being simply lifted off of the frame 210.

Although no separate fasteners may be required in some cases, some examples may include a select number of fasteners at appropriate locations. In some cases, fasteners may be arranged to be only at locations that are likely to be easily accessible to technicians (e.g., only on front surfaces of the cover). In this regard, for example, fastener receivers 244 are disposed on the front wall 232 of the support tray 230 and are configured to align with the fastener holes 144 of the cover 100 when the cover 100 is removably attached to the frame 210. In the illustrated example the fastener receivers 244 are threaded holes configured to receive screws 254 inserted through the fastener holes 144 to secure the front wall 110 of the cover 100 to the front wall 232 of the support tray 230 of the frame 210. Other fastening structures known in the art can be used to secure the cover 100 to the frame 210, including holes as formed or shaped by self-tapping screws.

In other examples, one or more fastener holes 144 of the cover 100 are disposed on the left and right side walls 114, 116 of the cover 100 and one or more fastener receivers 244 are disposed on the left and right side walls 216, 218 of the frame 210 to secure the cover 100 to the frame 210.

Figure 7:
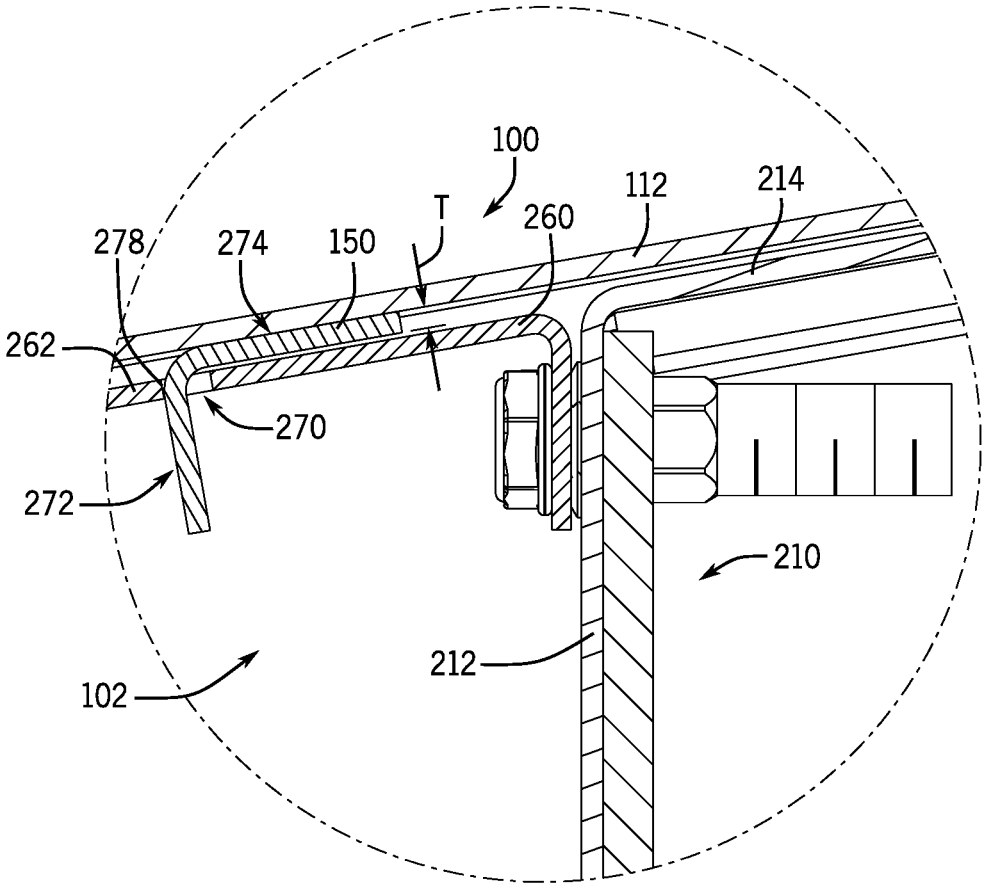
FIG. 7 is a detailed view of detail A of the air conditioner of FIG. 6.

FIG. 7 shows a detailed view of the tab 150 of the cover 100 engaged with the opening 270 of the bracket 260 of the frame 210. In the illustrated example, the bracket top wall 262 is parallel to the top wall 214 of the frame 210 and is offset from the top wall 214 of the frame 210 by a distance greater than or equal to a thickness T of an upper portion 274 of the tab 150. Thus, for example, the upper portion 274 of the tab 150 may not prevent the cover 100 from sitting flushly on the top wall 214 of the frame 210. A lower portion 272 of the tab 150 contacts a front surface 278 of the opening 270 and, in the illustrated example, is disposed at an angle of 90 degrees relative to the upper portion 274 of the tab 150. Thus, particularly when bent at 90 degrees (or more) relative to the upper portion 274, the lower portion 272 of the tab 150 can help to prevent the cover 100 from sliding along the frame 210 after installation.

In other examples the lower portion 272 of the tab 150 can be disposed at other angles relative to the upper portion 274 of the tab 150 (e.g., in a range of about 90 to 145 degrees). In other examples, the upper portion 274 of the tab 150 can have a thickness T that is less than or greater than a thickness of the lower portion 272 of the tab 150. In some examples, the tab 150 (or at least the lower portion 272) can be rotatably movable relative to the top wall 112 of the cover 100.

Also as illustrated, the tab 150 can be arranged along the cover 100 so as to be located clear of an enclosed portion of the frame 210 (e.g., as partly bounded by the top wall 214 of the frame 210, which can supportively contact the top wall 112 of the cover). In other words, as measured along the top wall 112 of the cover or the top wall 214 of the frame 210, the tab 150 can be arranged farther away from the rear side 118 of the cover 100 than a thickness of the enclosed portion of the frame 210 along the same direction. Thus, for example, the opening 270 can be arranged to be clear of the enclosed portion of the frame 210 and may not need to be sealed against ingress of material into the enclosure. Correspondingly, in some cases, a bracket can extend forward of an enclosed portion of a frame to define an opening (e.g., a laterally elongate slot, as illustrated) to receive a tab of a cover.

FIGS. 8-11 illustrate another example configuration of the air conditioner 200 according to the disclosed technology. In the illustrated configuration, a flange can be arranged on an interior side of a front wall of the cover 100, so that the cover 100 can be easily and reliably installed to provide efficient air flow to cool the air conditioner 200.

For example, as shown in FIG. 8 in particular, the air conditioner 200 includes a fan 380 disposed on a front surface 264 of the bracket 260. The fan 380 is configured to be in fluid connection with the air intake opening 148 and the air inlet opening 130 of the cover 100 when the cover 100 is removably attached to the frame 210.

Figure 9:
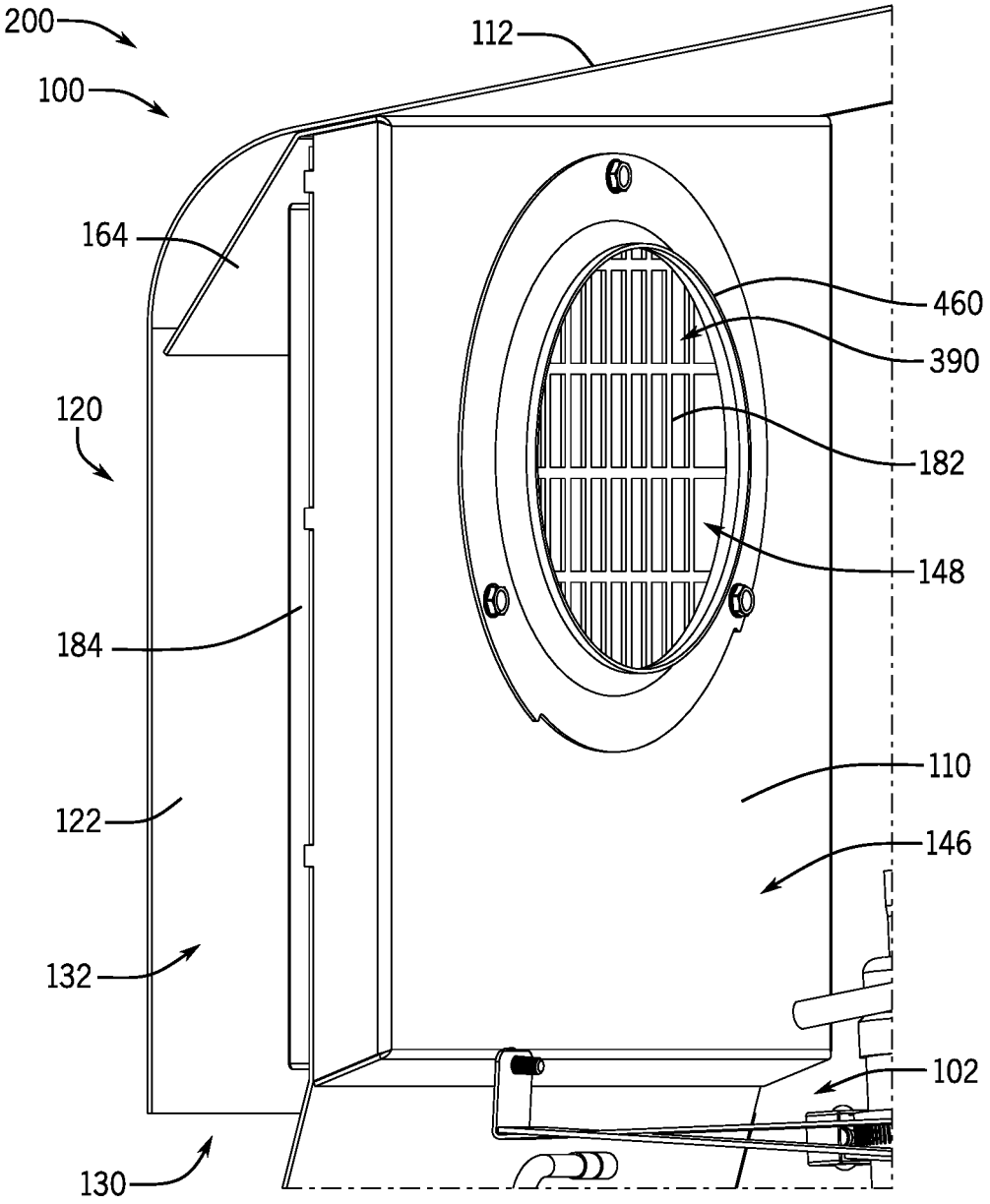
FIG. 9 is sectional partial rear isometric view of the cover of the air conditioner of FIG. 8.
Figure 10:
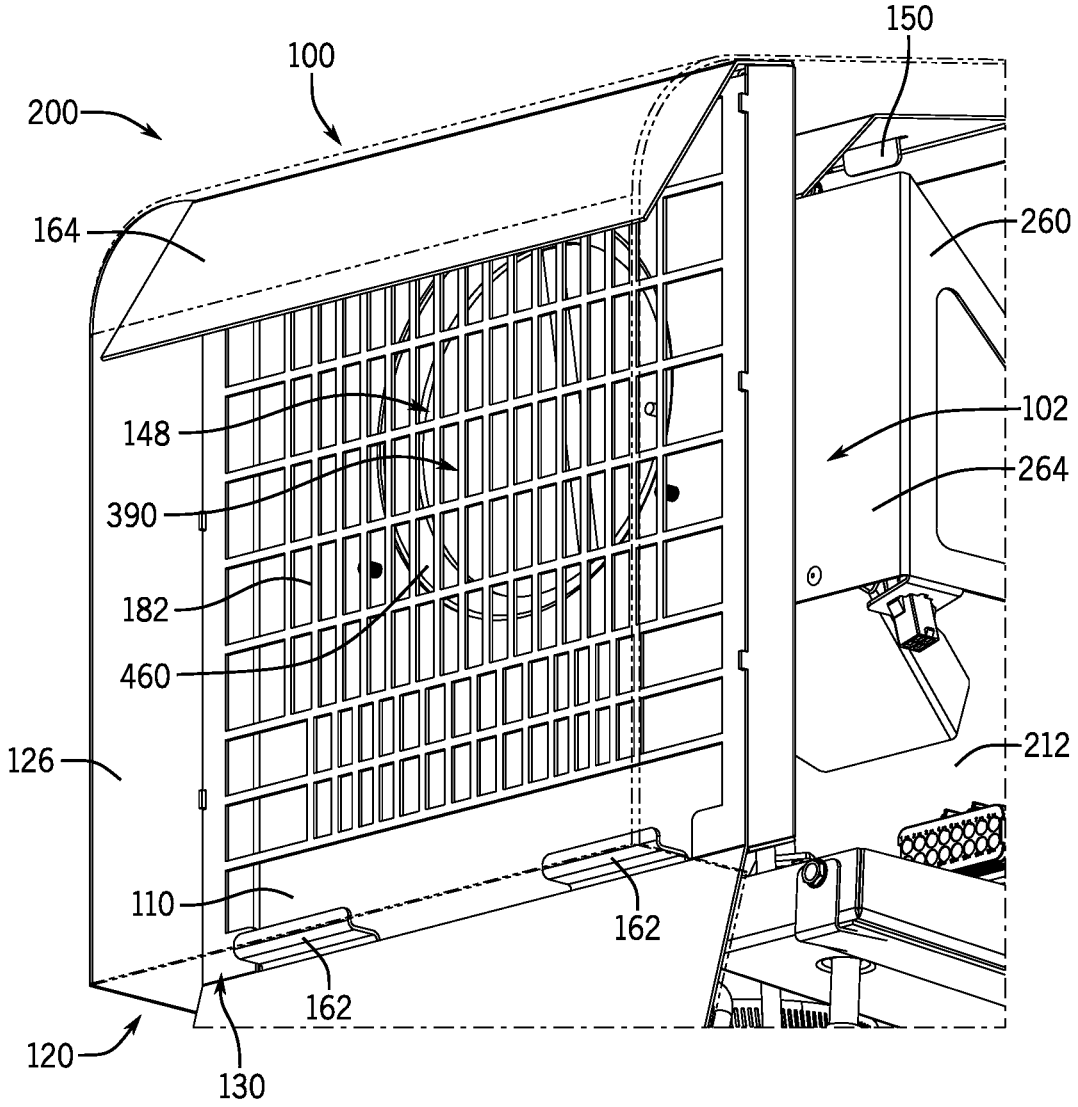
FIG. 10 is a front isometric view of the cover of the air conditioner of FIG. 8, with portions of the cover rendered transparently to reveal internal components.
Figure 11:
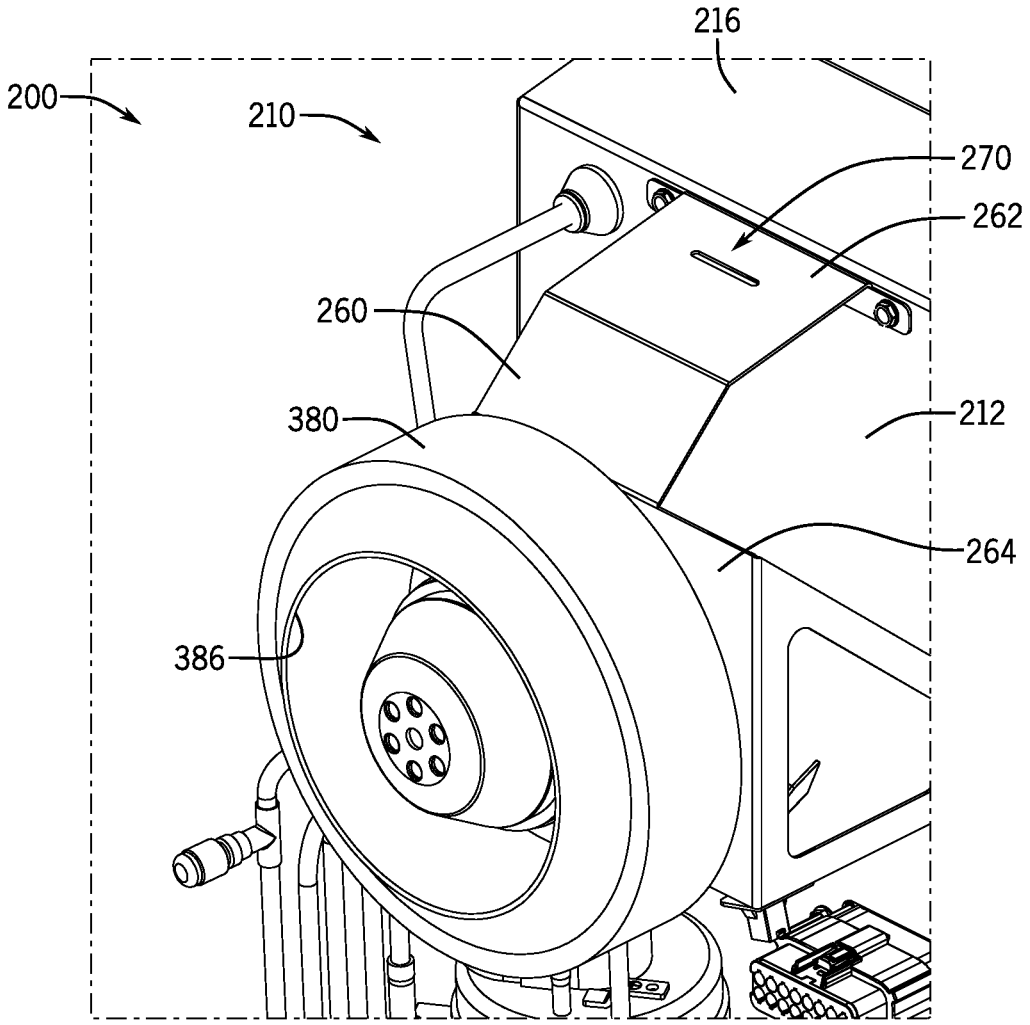
FIG. 11 is partial front isometric view of the air conditioner of FIG. 8 with the cover removed.

Looking at FIGS. 9 and 10, the air intake opening 148 includes an annular flange 460 extending from the front wall 110 towards the rear of the cover 100. The annular flange 460 can be integrally formed with or otherwise secured to the front wall 110 of the cover 100. The annular flange 460 is configured to be moved into alignment with an annular rim 386 (see FIG. 11) included on the fan 380 of the air conditioner 200, when the cover 100 is removably attached to the frame 210, to collectively define an air intake passage 390 of the air conditioner 200 (see, e.g., FIG. 8) that extends into the interior compartment 102 from the air intake opening 148.

In some implementations, devices or systems disclosed herein can be utilized, manufactured, or installed using methods embodying aspects of the disclosed technology. Correspondingly, any description herein of particular features, capabilities, or intended purposes of a device or system is generally intended to include disclosure of a method of using such devices for the intended purposes, of a method of otherwise implementing such capabilities, of a method of manufacturing relevant components of such a device or system (or the device or system as a whole), and of a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as examples of the disclosed technology, of the utilized features and implemented capabilities of such device or system.

For example, with reference again to FIGS. 4 and 5, some examples can include a method by which a user can removably attach the cover 100 to the frame 210 of the air conditioner 200. With the left and right side walls 114, 116 of the cover 100 aligned with the left and right side walls 216, 218 of the frame 210, respectively, a user can lower the cover 100 onto the frame 210 towards the support tray 230 of the frame 210. While the user lowers the cover 100 onto the frame 210, the user inserts the tab 150 of the cover 100 into the opening 270 of the frame 210 and aligns the free ends of the side clips 152, 154 of the cover 100 with the interior of the side walls 234, 236, respectively, of the support tray 230 of the frame 210. It should be understood that it is contemplated that the method described above can be reversed to detach the cover 100 from the frame 210 of the air conditioner 200.

As used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "only one of," or "exactly one of." For example, a list of "only one of A, B, or C" indicates options of: A, but not B and C; B, but not A and C; and C, but not A and B. In contrast, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more A, one or more B, and one or more C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: one or more A and one or more B; one or more B and one or more C; one or more A and one or more C; and one or more A, one or more B, and one or more C.

Also as used herein, unless otherwise limited or defined, "integral" and derivatives thereof (e.g., "integrally") describe elements that are manufactured as a single piece without fasteners, adhesive, or the like to secure separate components together. For example, an element stamped, cast, or otherwise molded as a single-piece component from a single piece of sheet metal or using a single mold, without rivets, screws, or adhesive to hold separately formed pieces together is an integral (and integrally formed) element. In contrast, an element formed from multiple pieces that are separately formed initially then later connected together, is not an integral (or integrally formed) element.

The previous description of the disclosed examples is provided to enable any person skilled in the art to make or use the disclosed technology. Various modifications to these examples will be readily apparent to those skilled in the art, and the generic principles defined herein may be applied to other examples without departing from the spirit or scope of the disclosed technology. Thus, the disclosed technology is not intended to be limited to the examples shown herein but is to be accorded the widest scope consistent with the principles and novel features disclosed herein.

The invention claimed is:

1. A cover for an air conditioner for an enclosure, the cover comprising:

a first side wall, a second side wall, and a top wall that at least partly surround an interior compartment of the cover that is sized to receive the air conditioner, with the first side wall on an opposite side of the interior compartment from the second side wall;

a tab that extends from the top wall of the cover into the interior compartment of the cover and arranged to engage the air conditioner to retain the cover on the air conditioner;

a first side clip that extends obliquely from the first side wall of the cover into the interior compartment and arranged to engage the air conditioner to retain the cover on the air conditioner;

a second side clip that extends obliquely from the second side wall of the cover into the interior compartment and arranged to engage the air conditioner to retain the cover on the air conditioner; and an air intake opening configured for air flow into the interior compartment, wherein the first side clip is a first angled tab configured to seat on an edge of a first side wall of the air conditioner adjacent to the first side wall of the cover within the interior compartment, and wherein the second side clip is a second angled tab configured to seat on an edge of a second side wall of the air conditioner adjacent to the second side wall of the cover within the interior compartment.

2. The cover of claim 1, wherein the first and second side clips angle obliquely away from the first and second side walls, respectively, toward an open bottom end of the cover and are configured to engage the air conditioner to secure the cover against lateral movement without use of separate fasteners.

3. The cover of claim 2, wherein the tab extends perpendicularly from the top wall and is configured to be removably received in a bracket opening on a bracket of the air conditioner within the interior compartment to secure the cover against lateral and downward movement without use of fasteners, the bracket opening being arranged adjacent to the top wall.

4. The cover of claim 1, further comprising:

a front wall that defines the air intake opening into the interior compartment; and a shroud forward of the front wall to define an internal shroud area in communication with the air intake opening, and an air inlet opening of the shroud that opens into the internal shroud area.

5. The cover of claim 4, wherein a support shelf extends from the front wall into the internal shroud area adjacent a retention frame, the support shelf being arranged to support filter media relative to gravity adjacent to the retention frame, the retention frame being arranged to support the filter media relative to the air flow into the interior compartment from the internal shroud area.

6. The cover of claim 5, further comprising: a filter guide disposed within the internal shroud area and above the support shelf, the filter guide being angled downwardly toward the air inlet opening to guide the filter media toward the air intake opening defined by the front wall of the cover as the filter media is received upwardly into the internal shroud area.

7. The cover of claim 6, wherein the filter guide is integrally formed with the front wall of the cover.

8. The cover of claim 5, wherein the front wall defines an air filter recess adjacent to the air intake opening; and wherein the retention frame extends across the air filter recess so that the retention frame is spaced apart from the air intake opening by a flow gap.

9. A covered air conditioner for an enclosure having an interior volume, the covered air conditioner comprising:

a frame configured to attach to an enclosure to support air conditioning components adjacent to an air-exchange opening of the enclosure;

one or more side support brackets arranged to extend from the frame away from the enclosure when the frame is attached to the enclosure, the one or more side support brackets defining a first support side wall and a second support side wall opposite the first support side wall;

a top support bracket arranged to extend away from the enclosure when the frame is attached to the enclosure, the top support bracket having a top support wall that defines a top support bracket opening; and a cover that is configured to be removably attachable to the frame to cover the air conditioning components, the cover including:

a cover top wall, a first cover side wall, and a second cover side wall, opposite the first cover side wall, that at least partly define an interior compartment configured to receive the air conditioning components;

a tab that extends from the cover top wall and is received in the top support bracket opening of the top support bracket to secure the cover against movement in a first direction relative to the frame;

a first side clip that extends from the first cover side wall and is slidably seated on the first support side wall of the one or more side support brackets to secure the cover against movement in a second direction relative to the frame, the second direction being different than the first direction; and a second side clip that extends from the second cover side wall and is slidably seated on the second support wall of the one or more side support brackets to secure the cover against movement in the second direction.

10. The covered air conditioner of claim 9, wherein the top support wall of the top support bracket is adjacent to and extends in parallel with a top frame wall of the frame.

11. The covered air conditioner of claim 9, further comprising:

a fan supported by the top support bracket;

wherein the cover further includes an air intake opening surrounded by an annular flange, the annular flange being aligned with an annular rim of the fan when the cover is removably attached to the frame, to define an air intake passage of the covered air conditioner.

12. The covered air conditioner of claim 9, wherein the one or more side support brackets extend from a bottom portion of the frame and support a drainage grate.

13. The covered air conditioner of claim 9, wherein the cover further includes a shroud arranged to extend away from the enclosure when the cover is removably attached to the frame, the shroud defining an air inlet opening of the cover that opens in a downward direction relative to the cover top wall; and wherein a first portion of a front wall of the cover that is below the air inlet opening angles downwardly away from the interior compartment.

14. The covered air conditioner of claim 13, wherein a second portion of the front wall of the cover that is below the first portion of the front wall, includes one or more fastener openings to secure the cover to the one or more side support brackets of the frame.

15. A method for attaching a cover to an air conditioner for an enclosure, the method comprising:

positioning the cover to align an interior compartment of the cover with a frame of the air conditioner, the frame being secured to the enclosure, the cover including a first side wall, a second side wall opposite the first side wall, and a top wall that together at least partly define the interior compartment, the cover defining an air intake opening that permits air flow into the interior compartment; and after aligning the interior compartment of the cover with the frame, lowering the cover onto the frame to:

engage an opening defined on a top support wall of a first support bracket of the frame with a tab extending from the top wall of the cover into the interior compartment;

engage a first support side wall of one or more side support brackets of the frame with a first side clip of the cover, the first side clip extending obliquely from the first side wall of the cover into the interior compartment; and engage a second support side wall of the one or more side support brackets that is opposite the first support side wall with a second side clip of the cover, the second side clip extending obliquely from the second side wall of the cover into the interior compartment.

16. The method of claim 15, wherein the first side clip engages a first top edge of the first support side wall and the second side clip engages a second top edge of the second support side wall.

17. The method of claim 15, wherein, when the tab of the cover is received in the opening of the top support wall of the first support bracket, the first side clip extends along an interior side of the first support side wall of the one or more side support brackets and the second side clip extends along an interior side of the second support side wall of the one or more side support brackets.

18. The method of claim 17, wherein, after lowering the cover onto the frame, the cover is supported by the top support wall of the first support bracket relative to the frame, the first and second side clips prevent movement of the cover downward or laterally relative to the frame, and the tab prevents movement of the cover toward or away from the enclosure.

19. The method of claim 15, further comprising:

after lowering the cover onto the frame, securing a front wall of the cover to a front support wall of the one or more side support brackets with one or more fasteners.

* * * * *